United States Patent [19]

Hanley et al.

[11] Patent Number: 4,791,010

[45] Date of Patent: Dec. 13, 1988

[54] SIMULATED ETCHED GLASS WINDOW AND METHOD

[76] Inventors: Paul A. Hanley, 1788 Baker; Robert J. Plesscher, 5690 Babbitt, both of Haslett, Mich. 48840

[21] Appl. No.: 83,163

[22] Filed: Aug. 10, 1987

[51] Int. Cl.[4] ..... B44D 5/00

[52] U.S. Cl. ..... 428/34; 156/109; 428/38

[58] Field of Search ..... 428/34, 38; 156/109

[56] References Cited

U.S. PATENT DOCUMENTS

| | | | |
|---|---|---|---|
| 21,896 | 10/1858 | Miles | 428/34 |
| 4,070,781 | 1/1978 | Sauer | 428/187 X |
| 4,308,316 | 12/1981 | Gordon | 428/34 X |
| 4,528,232 | 8/1985 | Cliffe | 428/187 X |
| 4,581,266 | 4/1986 | Magnotta | 428/187 X |
| 4,673,609 | 6/1987 | Hill | 428/187 |

FOREIGN PATENT DOCUMENTS

| | | | |
|---|---|---|---|
| 2045326 | 10/1980 | United Kingdom | 428/34 |

*Primary Examiner*—Henry F. Epstein
*Attorney, Agent, or Firm*—Ian C. McLeod

[57] ABSTRACT

A simulated etched glass window (10) which is applied on a glass pane (11 and/or 12) using a unique liquid mixture of an ink and varnish and dried to form a design (13). An insulated glass window with the design is particularly described. The design visually duplicates true etched glass and strengthens the glass pane.

15 Claims, 2 Drawing Sheets

SIMULATED ETCHED GLASS WINDOW AND METHOD

BACKGROUND OF THE INVENTION (1) Summary of the Invention

The present invention relates to a method for producing a novel simulated etched glass window. In particular, the present invention relates to a simulated etched glass window which can not be visually distinguished from true etched glass and which can be modified to produce a variety of colors with the translucent frosted appearance of true etched glass.

(2) Prior Art

The etching of glass to provide a design cut into a surface of the glass is a very old art. This is accomplished by chemically etching the glass or with mechanical abrasion of the glass such as by sandblasting. The problem is that the prior art methods are labor intensive and thus expensive and sometimes hazardous and the resulting etched glass is weakened. The prior art etches the glass which must be then heated for tempering to reduce stress produced by the etching. Thus true etched glass results in a window which is prone to breakage, particularly if it is on the outside pane of a window.

The problem has been that the prior art has been unable to produce a simulated etched glass which exactly reproduces the true etched glass appearance. Further, it has not been possible to provide varying colors in a true etched glass design with an etched glass appearance.

The prior art has shown screen printing in various forms but not simulated etched glass. Illustrative are U.S. Pat. Nos. 4,070,781 to Sauer; 4,528,232 to Cliffe; 4,581,266 to Magnotta; and 4,673,609 to Hill.

OBJECTS

It is an object of the present invention to provide a method for producing a simulated etched glass which exactly reproduces the appearance of true etched glass. Further it is an object of the present invention to provide a simulated etched glass which can be colored. Further, it is an object of the present invention to provide a double glazed, insulated glass window with a simulated etched glass design on an inside surface of an outside pane. Further, it is an object to provide a simulated etched glass window with a resin composition forming the simulated etched glass design which increases the resistance of an outside window to breakage. Further still, it is an object of the present invention to provide a method for fabricating the simulated glass window which is simple and economical. These and other objects will become increasingly apparent by reference to the following description and the drawings.

GENERAL DESCRIPTION

The present invention relates to an improvement in a window glass pane having an inside surface and an outside surface for simulating etched glass which comprises: a small amount of a dried ink and clear varnish mixture which adheres to the glass pane on the inside surface to provide a translucent appearing, frosted design, wherein the varnish constitutes at least about 99 percent by volume of the mixture.

The present invention particularly relates to an improvement for simulating etched glass in an insulated glass window including two spaced apart inner and outer panes of glass with aligned outer edges around an enclosed space and each pane having an inside and outside surface and a sealing strip adjacent the outer edges and on the inside surfaces between the panes, spacers adjacent the sealing strip within the enclosed space with perforations facing the enclosed space and a drying agent in the enclosed space which removes moisture from the enclosed space which comprises: a small amount of dried ink and a clear varnish mixture which adheres to the glass provided on the inside surface of the inner or outer pane as a translucent appearing, frosted design, wherein the varnish constitutes at least about 99 percent by volume of the mixture.

The present invention relates to the improvement for simulating etched glass in a method for forming an insulated glass window including two spaced apart inner and outer panes of glass having aligned outer edges around an enclosed space and each pane having an inside and outside surface and a sealing strip adjacent the outer edges and on the inside surfaces between the panes, spacers adjacent the sealing strip within the enclosed space and perforations facing the enclosed space and a drying agent in the spacer which removes moisture from the enclosed space, which comprises: applying a small amount of a liquid ink and clear varnish mixture on the inside surface of at least one of the inner or outer panes to provide a translucent appearing, frosted design, drying the liquid mixture on the pane to form a dried mixture which adheres to the glass pane, wherein the varnish constitutes at least about 99 percent by volume of the mixture and wherein the sealing strip is unaffected by the dried mixture over time; and forming the insulated glass window.

As used herein the phrase "simulated etched glass" means a glass pane which has the frosted appearance of true etched glass provided by a varnish and ink mixture and is either: (1) the translucent blue-white color of true etched glass; or, (2) colored with other colors to provide a design. Multiple colors can be included in the design to provide a unique appearance not achievable with true etched glass.

SPECIFIC DESCRIPTION

Figure 1:
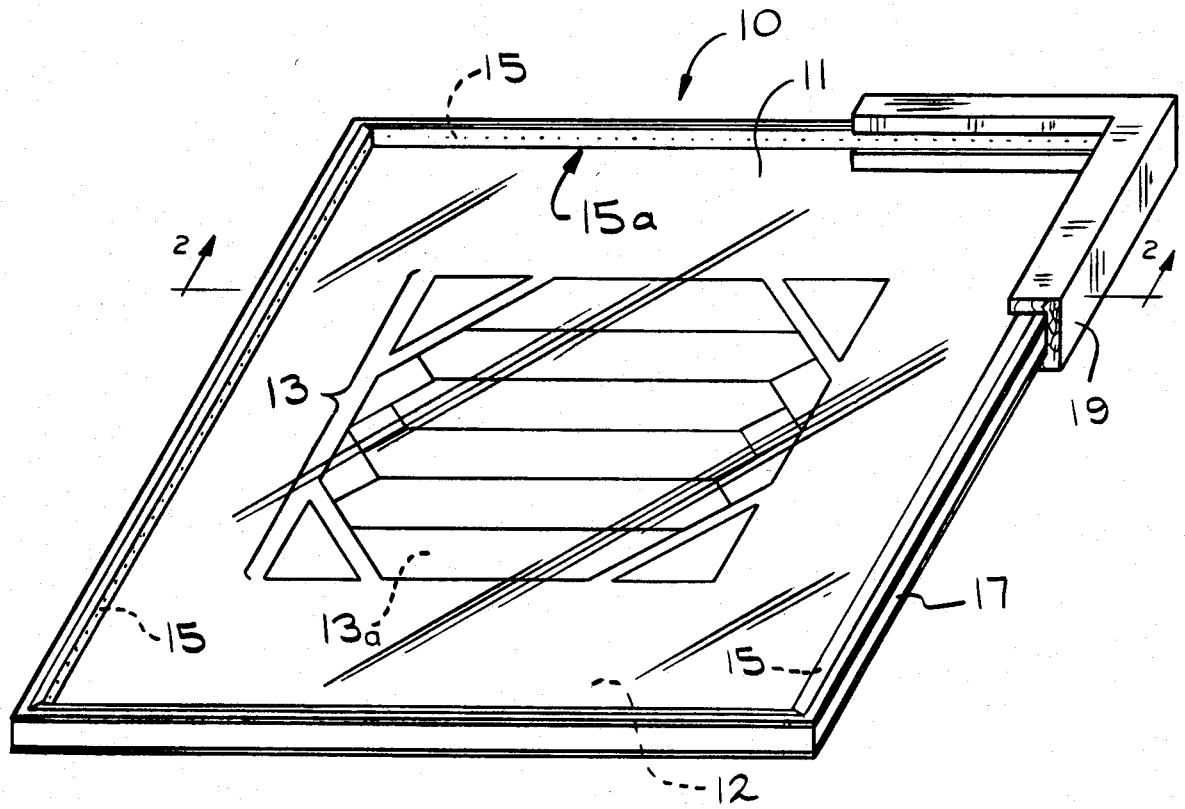
FIG. 1 is a front perspective view of a double glazed, insulated glass window 10 showing a simulated etched glass design 13 on an inside surface 12*a* of an outside pane 12.

FIG. 1 shows a double glazed insulated glass window 10 including inside pane 11 and outside pane 12. The pane 12 has a dried ink and clear varnish mixture 13*a* printed on an inside surface 12*a* which forms the design 13. The dried ink and clear varnish mixture 13*a* is in an enclosed space 14 between the panes 11 and 12. Framing spacers 15 are adhered adjacent to the outer edges of the aligned, spaced apart panes 11 and 12. Sealing materials 16 and 17 seal the edges of the panes 11 and 12. The spacers 15 have passages 15*a* which lead to a channel 15*b* inside the spacer 15. A drying agent 18 is provided inside the channels 15*b* and acts to remove moisture remaining in the confined space 14 after the sealing materials 16 and 17 are applied when the window 10 is fabricated. A suitable frame 19, made of wood, metal or plastic, is used to mount the window 10 in a framing opening in a solarium, retail store, restaurant or home or other structure.

Figure 2:
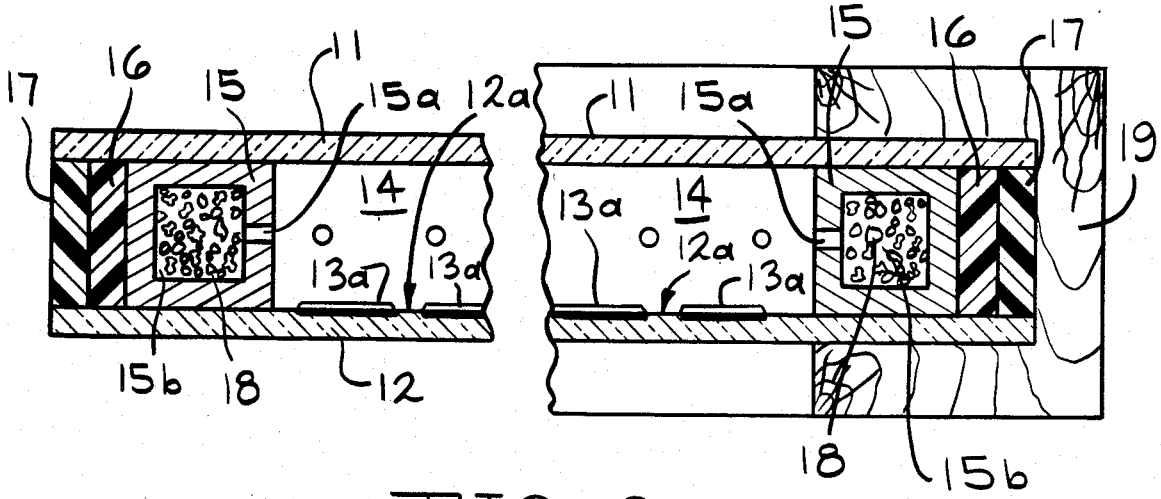
FIG. 2 is a cross-section along line 2—2 of FIG. 1 showing a dried clear varnish and ink mixture 13*a* forming the design 13 on pane 12 and the preferred construction of the insulated glass window 10.
Figure 3:
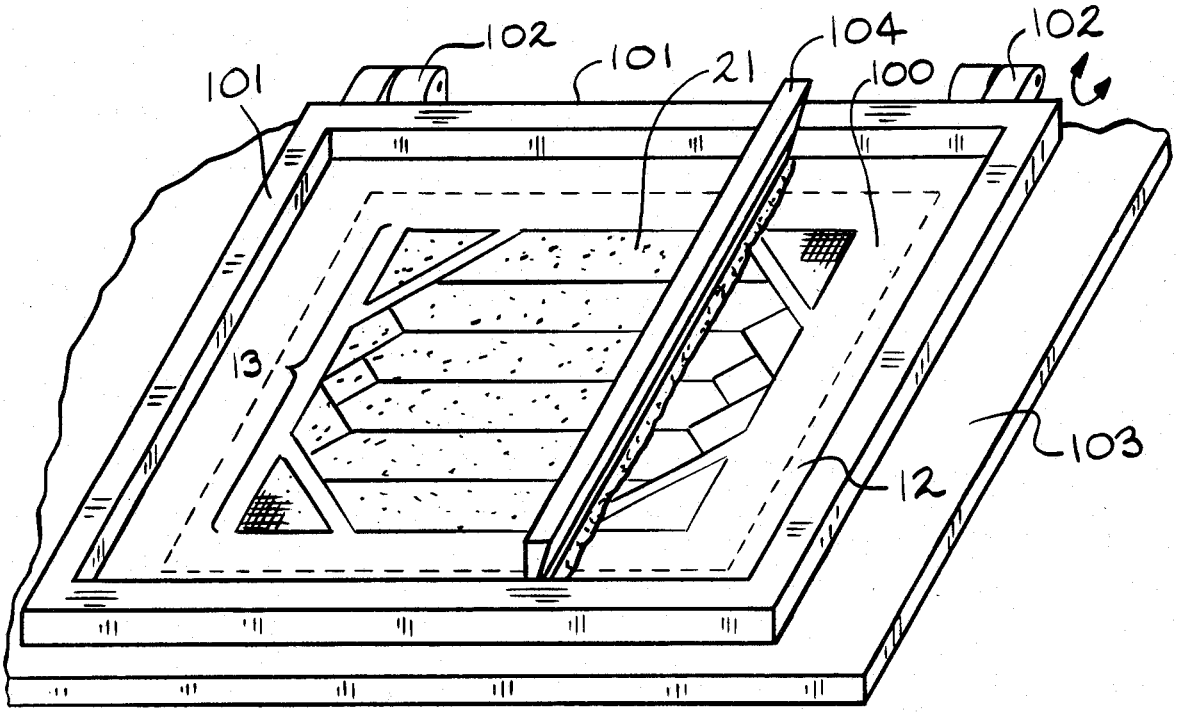
FIG. 3 is a front perspective view showing a silk screening of the design 13 on the pane 12 with a squeegee 104.
Figure 4:
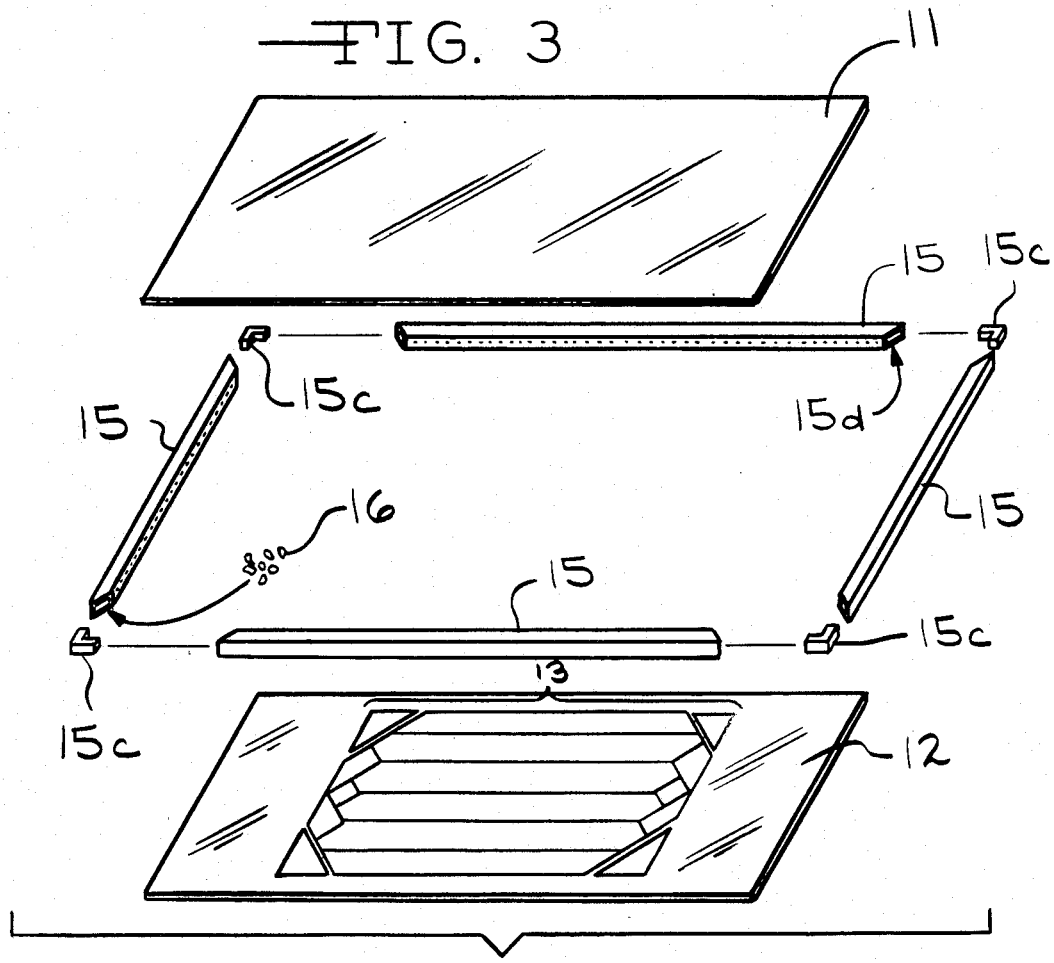
FIG. 4 is a separated front perspective view of the panes 11 and 12 and design 13 to be assembled with spacers 15 to form the insulated glass window 10.

The important steps in the fabrication of the window 10 are shown generally in FIGS. 3 and 4. The method of forming a double glazed, insulated glass window 10 is well known to those skilled in the art. To form the design 13, a silk screen 100 (200 to 300 mesh) is placed over the inside surface 12*a* of glass pane 12 as shown in FIG. 3. The screen 100 is mounted in a holder 101 which has a hinge 102 for rotating the screen 100 into or out of contact with the pane 12. The pane 12 is resting on a table 103. A squeegee 104 is moved from left to right, as shown in FIG. 3, to paint the liquid ink and clear varnish mixture 21 on the pane 12. This mixture 21 is then dried, preferably using air drying at 60° to 80° F. (15.6° to 26.7° C.) for 4 to 6 hours and holding for 24 hours or at elevated temperatures less than would damage the ink or varnish for faster drying, to provide the dried ink and clear varnish mixture 13*a* and design 13 as shown in FIG. 4 and in FIGS. 1 and 2. The double glazed, insulated glass window 10 is then assembled as shown in FIG. 4. Corner pieces 15*c* are conventionally used to assemble the spacer 15 at beveled corners 15*d* of the spacers 15. The spacers 15 are then sandwiched between the panes 11 and 12 and the sealing materials 16 and 17 are then inserted to bond the panes together and hold the spacers 15 in position, so as to adhere to the panes 11 and 12 as shown in FIG. 2.

Generally the sealing materials 16 and 17 are inserted by extruding them into place, usually using a tool similar to a powered caulking gun which dispenses the sealing materials as a paste. The sealing material 16 can be a polyisobutylate elastomer. The sealing material 17 can be a polysulfide elastomer. These sealant materials are well known to those skilled in the art. Generally any excess sealing material 17 is shaved off of the edges of the panes 11 and 12.

The inks are in the form of colored solid particles. The inks are usually dyes which have been insolubilized with a resin forming material such as an epoxide. The inks must be insoluble in the liquid varnish. The varnish is clear and can be an acrylic enamel for instance. The varnish serves as a carrier and adhesive for the ink and adheres the dried mixture 13*a* to the pane 12. The varnish must represent at least about 99 percent of the volume of the liquid mixture (20–40 cc of ink per 4.546 liters (1 gallon)) in order to achieve a simulated etched glass effect when dried which is the same as true etched glass. The simulated appearance of the true etched glass is achieved by using a ratio of white ink to blue ink is between about 75 to 25 and 25 to 75 percent by volume as a liquid.

The sealing materials and drying agent for insulated glass windows are unaffected by the dried ink and varnish mixture. The dried mixture on the pane of glass resists light and thermal deterioration because of the small amount of ink and the insoluble nature of the ink. The resulting glass pane is strengthened by the dried ink and varnish mixture. The simulated etched glass is in an insulated environment and is thus protected.

Single pane windows with a simulated etched glass design can be produced using the method of the present invention. It is preferred to provide the design 13 inside an enclosed space defined by at least two panes of glass such as in an insulated glass window to prevent damage to the design 13. Panes of glass could be laminated together.

It is intended that the foregoing description be only illustrative of the present invention and that the present invention be limited only by the hereinafter appended claims.

I claim:

1. In an insulated glass window including two spaced apart inner and outer panes of glass with aligned outer edges around an enclosed space and each pane having an inside and outside surface and a sealing strip adjacent the outer edges and on the inside surfaces between the panel, spacers adjacent the sealing strip within the enclosed space with perforations facing the enclosed space and a drying agent in the enclosed space which removes moisture from the enclosed space the improvement for simulating etched glass which comprises:

a small amount of dried ink and a clear varnish mixture which adheres to the glass provided on the inside surface of the inner or outer pane as a translucent appearing, frosted design, wherein the varnish constitutes at least about 99 percent by volume of the mixture wherein the enclosed space is substantially free of moisture which affects the dried mixture exposed to the enclosed space.

2. The window of claim 1 wherein the mixture of white ink and a different color ink which have been mixed together as a liquid and then mixed with the varnish as a liquid.

3. The window of claim 2 wherein the different color ink is blue.

4. The window of claim 3 wherein the ratio of white ink to blue ink is between about 75 to 25 and 25 to 75 percent by volume.

5. The window of claim 4 wherein the amount of the white ink and of the blue ink together to varnish is between about 20 and 40 cc of the inks per 4.546 liters blended together as the liquids which are dried to form the dried mixture.

6. The window of claim 1 wherein the dried mixture is in the form of a screen print on the pane.

7. The window of claim 6 wherein a screen having a mesh size of between about 200 and 300 mesh is used to produce the screen print.

8. The window of claim 1 wherein the spacers have a hollow rectangular cross-section with the drying agent inside the spacers.

9. In a method for forming an insulated glass window including two spaced apart inner and outer panes of glass with aligned outer edges around an enclosed space and each pane having an inside and outside surface and a sealing strip adjacent the outer edges and on the inside surfaces between the panes, spacers adjacent the sealing strip within the enclosed space with perforations facing the enclosed space and a drying agent in the spacer which removes moisture from the enclosed space, the improvement for simulating etched glass which comprises:

(a) applying a small amount of a liquid ink and clear varnish mixture which adheres to the glass pane on the inside surface of at least one of the inner or outer panes to provide a translucent appearing, frosted design;

(b) drying the liquid mixture on the pane to form a dried mixture which adheres to the glass pane, wherein the varnish constitutes at least about 99 percent by volume of the mixture and wherein the sealing strip is unaffected by the dried mixture over time; and (c) forming the insulated glass window wherein the enclosed space is substantially free of moisture which affects the dried mixture exposed to the enclosed space.

10. The method of claim 9 wherein the liquid ink and varnish mixture is applied on the pane in the form of a screen print on the glass.

11. The method of claim 10 wherein a screen having a mesh size between about 200 and 300 mesh is used to produce the screen print.

12. The method of claim 9 wherein the ink is a mixture of a white ink and a different color ink.

13. The method of claim 12 wherein the different color ink is blue.

14. The method of claim 13 wherein the ratio of liquid white ink to blue ink is between about 25 percent and 75 percent by volume and wherein the inks are mixed together and then mixed with the liquid varnish before being applied.

15. The method of claim 9 wherein the mixture is air dried for 4 to 6 hours at 60° to 80° F. and held for at least 24 hours prior to forming the insulated glass window.

* * * * *